United States Patent [19]

White

[11] Patent Number: 5,022,541

[45] Date of Patent: Jun. 11, 1991

[54] MERCHANDISING GONDOLA WITH CONVERTIBLE BASE

[75] Inventor: O. Timothy White, Carnesville, Ga.

[73] Assignee: The Mead Corporation, Atlanta, Ga.

[21] Appl. No.: 402,055

[22] Filed: Sep. 1, 1989

[51] Int. Cl.[5] ..... A47B 57/00

[52] U.S. Cl. ..... 211/186; 211/189; 108/108

[58] Field of Search ..... 211/186, 189; 108/108

[56] References Cited

U.S. PATENT DOCUMENTS

| | | | |
|---|---|---|---|
| 3,500,768 | 3/1970 | Lowe, Jr. et al. | 108/1 |
| 4,148,263 | 4/1979 | Suttles | 108/1 |
| 4,371,085 | 1/1983 | Fredrickson | 211/186 X |
| 4,379,431 | 4/1983 | Clement | 108/1 X |
| 4,401,223 | 8/1983 | Spamer | 108/1 X |
| 4,665,837 | 5/1987 | Muhl | 108/108 |

*Primary Examiner*—Blair M. Johnson

*Attorney, Agent, or Firm*—Howson & Howson

[57] ABSTRACT

In a soft drink merchandising gondola, a base shelf is convertible from a horizontal to a forwardly or rearwardly inclined condition by a reversible adapter interposable between the base shelf and a base shelf support. The adapter comprises a pair of wedges and a brace, and can be taken down, reassembled in compact form, and stowed underneath the base shelf when the base shelf is horizontal. The brace engages the elements of the base shelf support, to prevent horizontal movement of the brace along the direction of its length. Each wedge-shaped element has a split tab, receivable in either of two slots in the upper surface of a base shelf support element, and accessible by a screwdriver from the side of the base for spreading the tab elements to lock the tab in its slot. A dual-purpose panel serves as a stop to prevent articles from sliding off the base shelf when the shelf is forwardly inclined, and as a lower extension of the back panels of the gondola when the base shelf is horizontal or rearwardly inclined. The panel substantially meets the surface of the base shelf both when the shelf is horizontal, and when the base shelf is rearwardly inclined.

15 Claims, 5 Drawing Sheets

82
12
84
9
96
10
52
40
100
88
98
48
50
54
38
72
90
42
9
44
46
8
86
91
80
83
56
70
8
58
7
92
60
78
94
87
7
76
104
89
36
85
74
106
32
28
30
34

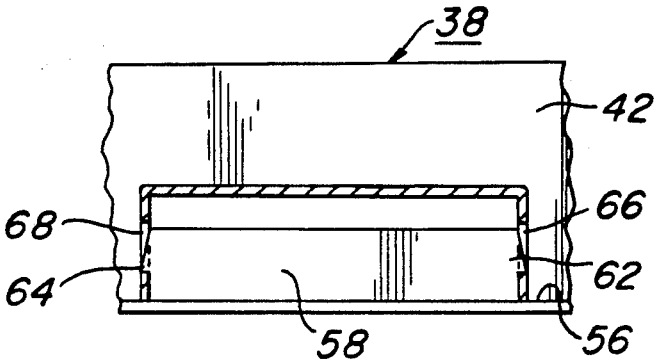
FIG. 7
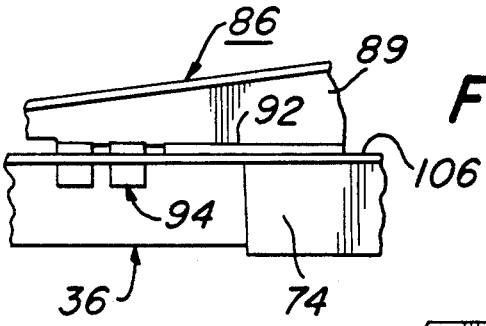
FIG. 10
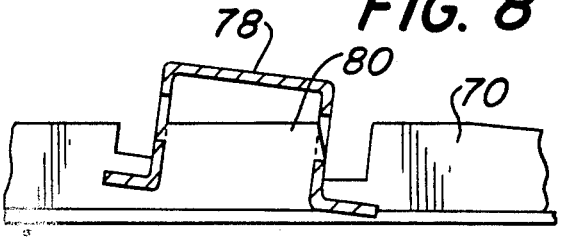
FIG. 8
FIG. 9
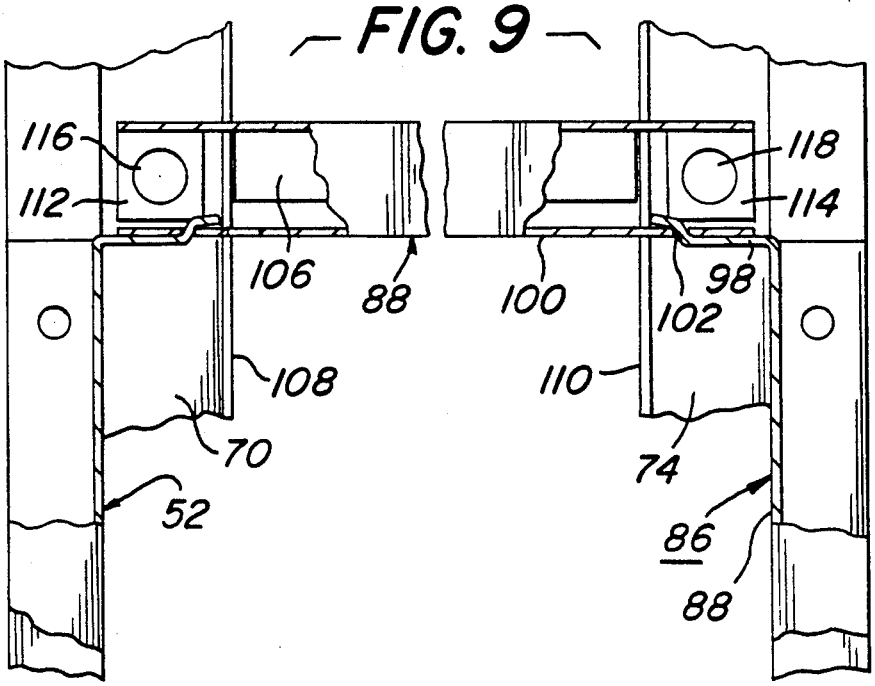

MERCHANDISING GONDOLA WITH CONVERTIBLE BASE

BRIEF SUMMARY OF THE INVENTION

This invention relates to merchandising gondolas of the kind used in supermarkets and convenience stores to display soft drinks in bottles, cans or cartons. It relates particularly to an improved base structure which allows the lowermost shelf of the gondola to be converted from a horizontal configuration to a forwardly or rearwardly sloping configuration.

Examples of merchandising gondolas of a type to which the present invention is applicable are described in U.S. Pat. No. 3,983,822 dated Oct. 5, 1976, U.S. Pat. No. 4,204,480 dated May 27, 1980, U.S. Pat. No. 4,535,704 dated Aug. 20, 1985, and U.S. Pat. No. 4,716,841 dated Jan. 5, 1988. These gondolas are characterized by an upright section supporting removable, cantilevered shelves, and a base extending forwardly from the lower end of the upright section. The upper part of the upright section is vertical, and the lower part slopes downwardly and forwardly. The shelves are attachable to slots provided on the upright section, and are capable of being positioned at any of a large number of selectable vertical locations. The base typically includes a shelf which slopes downwardly and rearwardly, in perpendicular relation to the lower part of the upright section, to allow cartons of soft drinks to be stacked on the shelf while leaning on the sloping face of the lower part of the upright section. This arrangement allows for stable stacking of soft drink cartons in stacks as many as four or more cartons high. Thus, in a typical gondola, the upper shelves were used to display bottles, while the lowermost shelf was used to support stacks of cartons, e.g. six-packs and eight-packs.

Soft drink merchandising gondolas are normally shipped to the stores in kits, and assembled on-site by store personnel. Because bottles will slide on a rearwardly sloping shelf, it is not practical to attempt to use the lowermost shelf to display individual bottles. Nevertheless, there are occasions in which it is desired to use the entire gondola to display individual bottles. Thus, it is desirable to provide the assembler of the kit with the option to erect it with the lowermost shelf horizontal, or to convert the lowermost shelf from a rearwardly sloping condition to a horizontal condition and vice-versa.

The problem of conversion is addressed in U.S. Pat. No. 4,332,204, dated June 1, 1982, in which the lowermost article-supporting surface of a soft drink merchandising gondola can be readily changed from a horizontal condition to a rearwardly sloping condition simply by reversing the lower shelf.

Another development in soft drink merchandising is the gravity feed shelf, in which soft drink bottles are arranged in tracks on forwardly sloping shelves. A gravity feed shelf is described in U.S. Pat. No. 4,239,099 dated Dec. 16, 1980 and U.S. Pat. No. 4,238,022, dated Dec. 9, 1980. As the foremost bottle on a track is removed by a customer, the bottles behind it move forward by gravity to present a new bottle at the forward edge of the shelf. It is also desirable, therefore, to provide the assembler of a gondola kit with the option of erecting it with the lowermost shelf sloping forwardly so that it can be used with gravity feed tracks.

The development of gravity-feed shelving is another reason why it is desirable to provide for conversion of the bottom shelf of a merchandising gondola from a rearwardly sloping configuration to a horizontal configuration. If the shelf immediately above the bottom shelf is a gravity-feed shelf, and the bottom shelf slopes rearwardly, the vertical distance between the front edges of the shelves is much smaller than the vertical distance between the rear edges. Consequently, there is a large amount of wasted space between the two shelves. If the bottom shelf is converted to a horizontal configuration, it can be used to support low stacks of soft drink cartons, with less waste of space.

In the design of soft drink merchandising gondolas, height and capacity are considered very important factors. The gondola must be carry the maximum number of soft drink containers while not exceeding a specified maximum height. The height of the base shelf affects the positioning of the upper shelves, and may ultimately affect the capacity of the gondola by making it impossible to position an uppermost shelf within the specified height limit.

In the case of a gondola having a bottom shelf convertible from a sloping condition to a horizontal condition, it is desirable to keep the shelf as low as possible, when horizontal, in order to maximize the gondola's capacity. In convertible gondolas such as the one described in U.S. Pat. No. 4,332,204, unfortunately, the shelf, when horizontal, is not significantly lower than the uppermost edge of the shelf when it is in the sloping condition. One approach to shelf conversion is to provide a wedge which can be placed on a horizontal bottom shelf to provide a sloping bottom shelf surface. However, the wedge is bulky, costly to ship, and inconvenient to store when not in use.

One of the objects of this invention is to provide a convertible base shelf in which the base shelf is at a minimum height when horizontal, while eliminating the problems associated with shipment and storage of bulky conversion wedges.

Further objects of the invention include structural simplicity and easy assembly of a convertible base; lightness in weight; strength and stability; convertability of the base to horizontal, rearwardly sloping and forwardly sloping conditions; reduction in the number of parts; the use of the same parts for different purposes depending on the base configuration; and, in the case of a gondola having back panels, the provision of a simple means to eliminate gaps between the base shelf and the back panels.

The invention addresses the problem of achieving the lowest possible bottom shelf while avoiding the need to ship and store bulky conversion wedges by means of a take-down structure interposable between the base shelf and a base shelf support. More specifically, the kit from which the gondola is assembled comprises a base shelf support having at least two spaced upper surfaces, and a base shelf removably supportable directly on the upper surfaces of the support. The base shelf has an article-supporting surface which is substantially horizontal when the base shelf is directly supported by the upper surfaces of the support. A pair of spaced wedge-shaped elements are interposable between the base shelf support and the base shelf for alternatively supporting the base shelf on the base shelf support with its article-supporting surface in an inclined condition. The first and second wedge-shaped elements are supportable respectively on the spaced upper surfaces of the base shelf support, and are stowable underneath the base shelf when the base shelf is directly supported on the upper surfaces of the base shelf support.

In the preferred form of the gondola kit, the wedge-shaped elements are connected by a brace, which supports them against tilting. The brace is preferably in the form of a channel, and the base shelf support preferably comprises two substantially parallel, spaced elements capable of supporting the opposite ends of the brace when the brace is stowed underneath the base shelf. The channel-shaped brace, in turn receives the wedge-shaped elements, so that the brace and wedge-shaped elements are stowed together underneath the base shelf and between the spaced elements of the base shelf support.

To provide additional support against tilting of the wedge-shaped elements, the brace preferably engages the parallel, spaced elements of the base shelf support, which prevent horizontal movement of the brace along the direction of its length.

Each of the wedge-shaped elements is preferably a sheet metal unit having a tapered web with diverging flanges. One of the flanges has a tab receivable in a slot in the upper surface of a base shelf support element. The tab is preferably in the form of a split tab having a space between the tab elements allowing insertion of a screw-driver to spread the tab elements for locking the tab in the slot. The upper surfaces of the base elements are formed by outwardly projecting flanges to allow easy access to the split tab.

The wedge-brace structure is preferably reversible to allow the base shelf to be supported in a forwardly inclined condition as well as in a rearwardly inclined condition. For optimum strength and stability, the wedge-brace structure is formed with the brace connecting the wide ends of the wedges and with the tabs near the narrow ends of the wedges. Two slots are provided in the upper surface of each of the base shelf support elements to permit reversal of the wedge-brace structure.

A dual-purpose panel is preferably provided, which serves as a stop to prevent articles from sliding off the base shelf when the shelf is forwardly inclined, and as a lower extension of the back panels of the gondola when the base shelf is horizontal or rearwardly inclined. The panel substantially meets the surface of the base shelf when the shelf is horizontal, and the wedge-brace structure is designed to position the base shelf so that it is also substantially met by the panel when the base shelf is rearwardly inclined.

Further features, objects and advantages of the invention will become apparent from the following detailed description, when read in conjunction with the drawings.

BRIEF DESCRIPTION OF THE DRAWINGS

FIG. 7 is a vertical section, taken on plane 7—7 of FIG. 2, illustrating the manner in which a front spreader is secured to the elements of the base shelf support;

FIG. 8 is a vertical section, taken on plane 8—8 of FIG. 2, illustrating the manner in which a rear spreader is secured to the elements of the base shelf support;

FIG. 9 is a horizontal section, taken on plane 9—9 of FIG. 2, illustrating the manner in which the brace is attached to the wedge-shaped elements, and FIG. 10 is a fragmentary elevational view illustrating the manner in which a wedge-shaped element is secured to a base shelf support member by a split tab.

DETAILED DESCRIPTION

Figure 1:
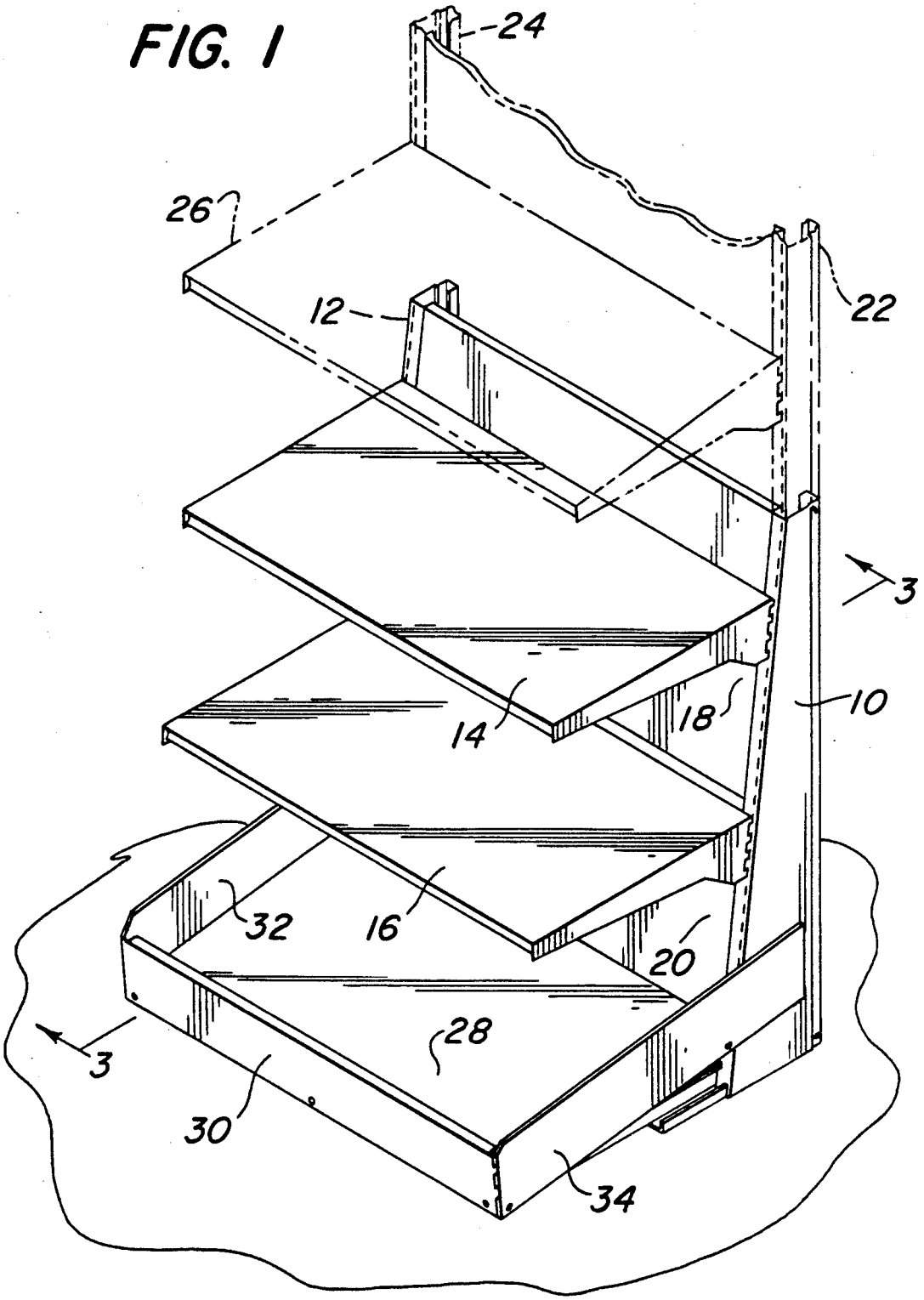
FIG. 1 is a fragmentary perspective view of a merchandising gondola in accordance with the invention, showing the base shelf in the forwardly inclined condition.

A typical merchandising gondola, as shown in FIG. 1, comprises a pair of upright members 10 and 12, each having a row of slots for receiving tabs extending rearwardly from brackets of shelves 14 and 16. The lower upright members have sloping front faces, and are connected by panels 18 and 20, which form an inclined backing, typically inclined at an angle of seven degrees from vertical. Extensions 22 and 24 may be provided at the upper ends of the lower upright members to support further shelves such as shelf 26. A base shelf 28 is shown in a forwardly inclined condition. A panel 30 is secured by fasteners to the front edge of the base shelf, and serves as a stop to prevent bottles from sliding off the base shelf. Gravity feed tracks (not shown) may be provided on the base shelf to guide rows of bottles toward the front edge of the base shelf, so that, when a foremost bottle in a track is removed by a customer, the remaining bottles move forward to present a new bottle at the front edge of the base shelf. Side panels 32 and 34 may be secured by fasteners to the sides of the base shelf.

Figure 2:
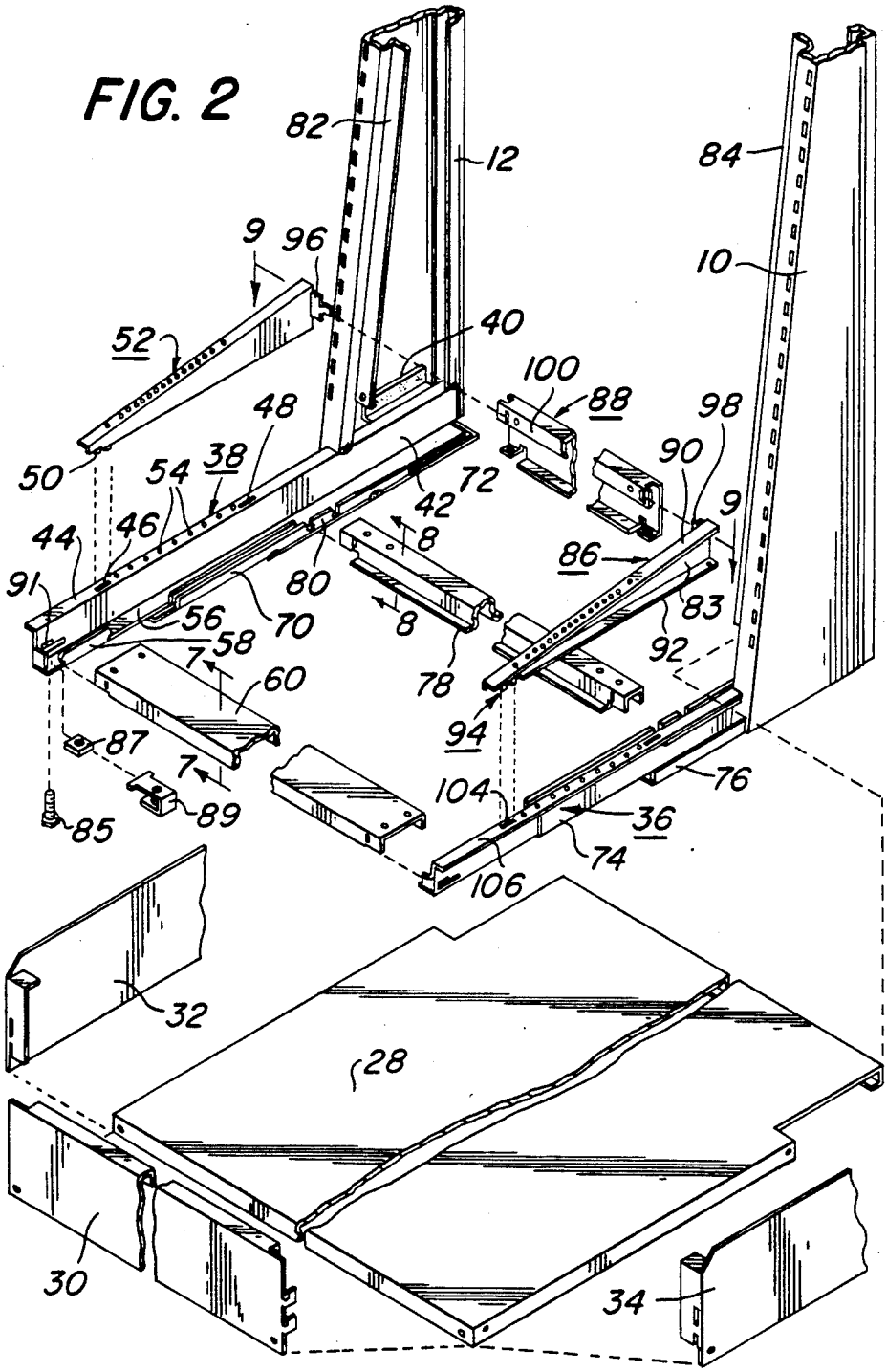
FIG. 2 is an exploded perspective view of the lower part of the gondola of FIG. 1.

As shown in FIG. 2, upright member 10 has, extending forwardly from its lower end, a base shelf support element 36, and upright member 12 has a similar base shelf support element 38 extending forwardly from its lower end in substantially parallel, spaced relation to element 36. These forwardly extending base support elements are preferably secured permanently to the upright members by welding. A flange 40 of element 38, shown in FIG. 2, is spot welded to upright member 12, and each base shelf support element is welded to its corresponding upright member at several other points.

The forwardly extending base shelf support elements 36 and 38 are mirror images of each other. As seen in FIG. 2, element 38 has a vertical web 42 with a horizontal upper flange 44 extending in a direction away from the opposite base support element 36. Flange 44 has a front slot 46 and a rear slot 48 for alternatively receiving the tab 50 of a wedge-shaped element 52. A row of holes is provided in flange 44 between the slots to accommodate a projection (not shown in FIG. 2) on the bottom of the base shelf 28, in order to retain the base shelf in a selected one of a number of discrete positions in the fore-and-aft direction.

Base shelf support element 38 also has a flange 56 at the lower edge of web 42 extending horizontally toward the opposite base shelf support element 36. Near its forward end, flange 56 has an upright tab 58 adapted for connection to a channel-shaped front spreader 60. As shown in FIG. 7, tab 58 has projections 62 and 64 which snap into slots 66 and 68 respectively in the flanges of spreader 60 to secure the spreader to base shelf support element 38. Support element 38 is reinforced by a channel 70 and by an angle 72. A similar channel 74 and angle 76 reinforce support element 36. A rear spreader 78 snaps onto tab 80 formed by notches in a flange of channel 70, as shown in FIG. 8. The base shelf support elements are thus rigidly secured together by front and rear spreaders 60 and 78 (FIG. 2). The uprights 10 and 12 are securely held in fixed relationship to each other by panels, including panels 18 and 20 (FIG. 1), which are fastened to flanges 82 and 84.

The reversible adapter for interposition between the base shelf support elements and the base shelf comprises wedge-shaped element 52, a similar wedge-shaped element 86, and a channel-shaped brace 88. As seen in FIG. 2, wedge-shaped element 86 comprises a tapered web 83 and upper and lower flanges 90 and 92, which extend perpendicular to the web along the upper and lower edges thereof. The lower flange has a tab 94, which corresponds to tab 50 of wedge shaped element 52. The wide ends of the webs of the wedge-shaped members are provided with integrally formed tabs 96 and 98, which engage slots in a return flange 100 of the channel-shaped brace 88.

The manner in which the wedge-shaped elements are attached to the brace is more fully illustrated in FIG. 9, in which the tab 98 is shown with an offset end projecting through a vertically elongated slot 102 in return flange 100 of brace 88. The offset end of tab 98 is preferably made so that its vertical dimension is only slightly less than that of slot 102. The wedge-shaped element 86 is attached to the brace by first positioning the wedge-shaped element with its web 83 parallel to the length of the brace, then pushing the offset end of tab 98 through slot 102 and swinging the wedge-shaped element outwardly, using the slot and tab as a hinge until the main body of tab 98 comes into facing contact with return flange 100. The wedge-shaped element will then be perpendicular to the length of brace 88. Because of the elongation of slot 102 and the portion of the tab which enters it, the wedge-shaped member and brace will remain rigidly connected together so long as their perpendicular relationship is maintained.

The perpendicular relationship is maintained by the entry of tab 94 into slot 104 on the upper flange 106 of base shelf support 36. As shown in FIG. 10, tab 94 comprises two tab elements which, as supplied, lie in a common plane and have a space between them of approximately ⅛ inch to allow the tip of a screwdriver to be used to pry the tab elements into a non-coplanar relationship, thereby locking the wedge-shaped element to the base shelf support. Because the flanges 44 and 106 extend outwardly, i.e. away from the opposite base shelf support elements, the split tab is easily accessible from the side of the gondola.

Referring to FIG. 9, the lower flange 106 of brace 88 fits into the space between flanges 108 and 110 of flanges 70 and 74. This prevents the brace from moving horizontally along the direction of its length, and therefore rigidifies the assembly comprising the brace and the two wedge-shaped elements. Flange 106 engages the nut retainers when the assembly is reversed, and flange elements 112 and 114, which are higher than flange 110 rest on the nut retainers to support the brace. Holes 116 and 118 provide clearance for the threaded shanks of the adjustable feet.

Figure 3:
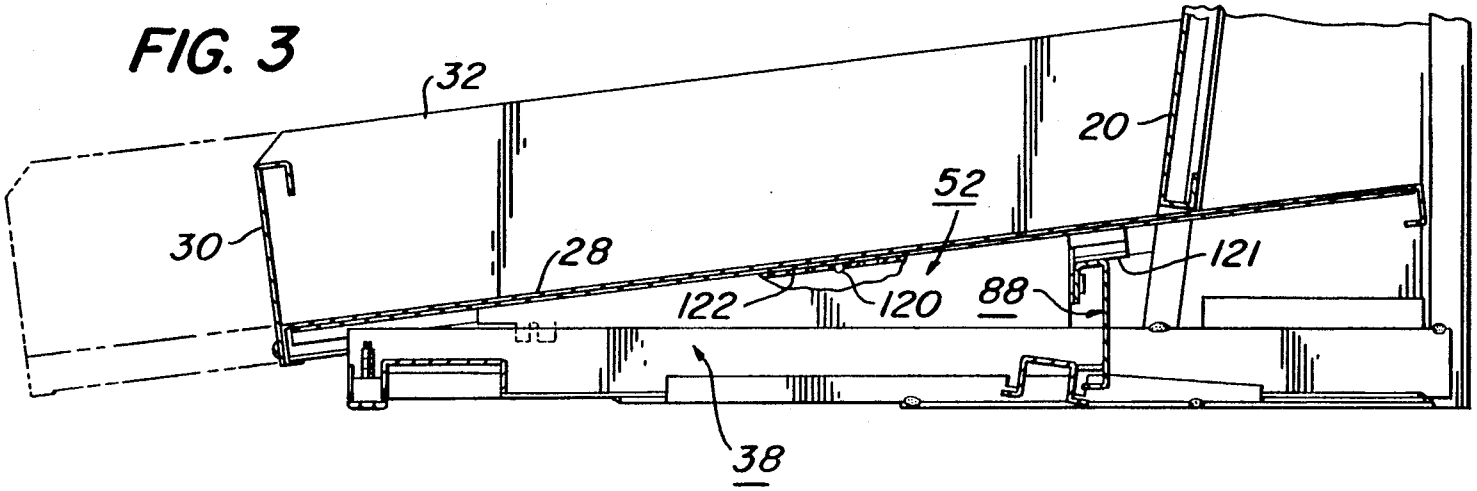
FIG. 3 is a vertical section taken on plane 3—3 of FIG. 1. showing the base shelf in a forwardly inclined condition.

FIG. 3 shows the base shelf 28 in its forwardly inclined condition, with a depending tab 120 on the underside of the shelf in engagement with one of a series of holes in the upper flange 122 of wedge-shaped element 52. A similar tab near the opposite edge of the base shelf is provided for engagement with the holes in the upper flange 90 of wedge-shaped element 86. The projections and holes allow for fore-and-aft adjustment of the base shelf, as shown in FIG. 3. The lower edge of rear panel 20 substantially meets the upper surface of the base shelf, there being a small gap to allow for adjusting movement of the shelf. Brace 88 provides support for shelf 28 by engagement with parallel ribs extending from front to rear on the underside of the shelf. One such rib is shown at 121.

Figure 4:
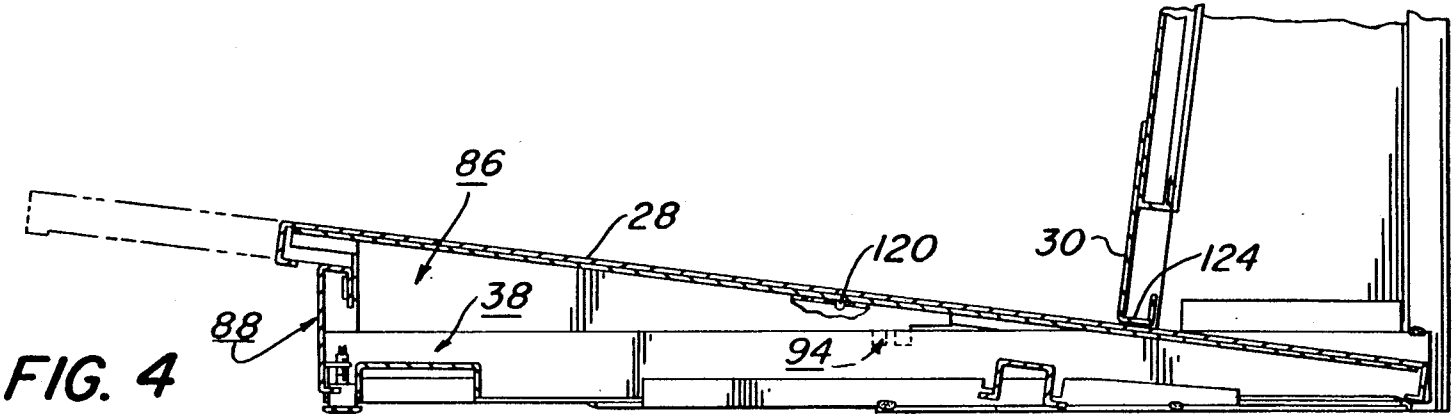
FIG. 4 is a similar vertical section showing the base shelf in its rearwardly inclined condition.

FIG. 4 shows the base shelf in the rearwardly inclined condition, with the entire assembly, including the brace and the wedge-shaped members reversed. Brace 88 is at the front of the base shelf support, wedge-shaped member 86 is situated on base shelf support member 38, and wedge-shaped member 52 is situated on base shelf support member 36. The wedge-shaped members have their wide ends toward the front of the base and their narrow ends toward the rear. Tab 94 of wedge-shaped member 86 enters slot 48 (FIG. 2) on the upper flange 44 of base shelf support member 38. Here again, brace 88 provides support for shelf 28 by engagement with the ribs extending from front to rear on the underside of the shelf.

As shown in FIG. 4, panel 30, which serves as a front rail for a forwardly inclined shelf, is secured to the uprights, preferably by engagement of its tabs (shown only in FIG. 1) with the slots of the uprights. Panel 30 is arranged with its return flange section 124 substantially meeting the upper surface of shelf 28, there being only a small gap to permit fore and aft adjustment of the shelf. Again, the projections at the bottom of the shelf engage holes in the upper flanges of the wedge-shaped elements to retain the base shelf in any selected one of a number of discrete positions in the fore-and-aft direction.

Figure 5:
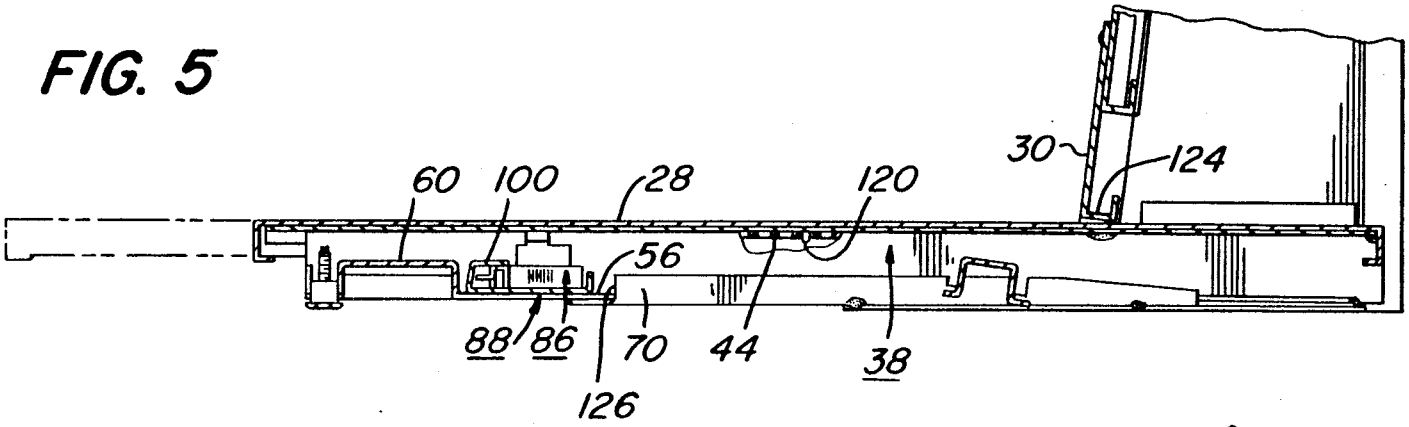
FIG. 5 is a similar vertical section showing the base shelf in its horizontal condition.

FIG. 5 shows the base shelf 28 in a horizontal position, supported directly on the upper flanges of the base shelf support members. The downward projections on the underside of the base shelf engage holes in the upper flanges of the support members to lock the shelf against fore-and-aft movement, while allowing positioning of the base shelf at any selected one of a plurality of discrete fore and aft positions. Projection 120 is shown in engagement with one of the holes in flange 44.

As shown in FIG. 4, the wedge shaped members are positioned to cause the upper surface of the base shelf to be substantially met by the lower edge of panel 30. In FIG. 5, panel 30 is in the same position as in FIG. 4, and again the return flange section 124 substantially meets the upper surface of the base shelf, there being only a small gap to permit fore-and-aft adjustment of the shelf. Thus panel 30, although in the same position relative to the uprights in FIGS. 4, and 5, substantially meets the upper surface of the base shelf in both the rearwardly inclined and horizontal configurations.

Figure 6:
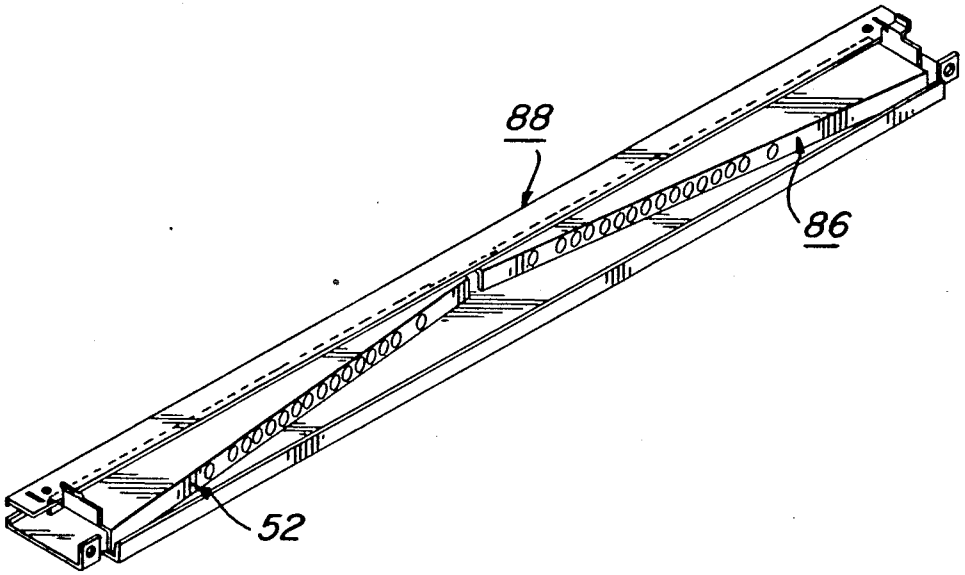
FIG. 6 is a perspective view illustrating the manner in which the wedge-shaped elements are received in the channel-shaped brace.

As shown in FIG. 6, both of the wedge-shaped elements 52 and 86 are received in the channel-shaped brace 88, being slid into the channel from the ends and held frictionally by the return flange. The assembly of FIG. 6 can then be stowed underneath the base shelf and between the base shelf support members, as shown in FIG. 5, with the ends of the brace being supported by the inwardly projecting lower flanges of the base shelf members. As seen in FIG. 5, the end of brace 88 resting on flange 56 of base shelf support member 38 is limited in its fore-and-aft movement by spreader 60 and the foremost edge 126 of flange 70. With the stowed wedges and brace supported on the base shelf support members in this manner, the gondola can be moved about on the floor in assembled condition.

When the wedge and brace assembly is stowed as shown in FIG. 5, the ribs on the underside of the shelf engage the return flange 100 of the brace, and consequently, the brace provides additional support for the shelf even in the stowed position.

As will be apparent from the foregoing discussion, the use of a three-piece wedge and brace assembly makes it possible to provide a gondola with a base shelf convertible from a horizontal condition to either a forwardly or rearwardly inclined condition, while minimizing the height of the base shelf when in its horizontal condition, and avoiding the difficulties of storing and shipping bulky adapters. The invention provides a structurally simple, yet extremely strong and versatile gondola base, which is easily assembled and modified. The dual-purpose panel 30, which serves as a stop to prevent articles from sliding off the base shelf when the shelf is forwardly inclined, and as a lower extension of the back panels of the gondola when the base shelf is horizontal or rearwardly inclined, reduces the total number of parts, and further reduces the problems associated with storage of unused parts. The invention also provides extremely simple means to eliminate large gaps between the base shelf and the back panels in a convertible base gondola.

The invention described above can be modified in various respects. For example, while the invention is described in the context of a gondola designed for cantilevered shelving, many of its features can be advantageously incorporated in a four-post gondola. While the wedge and brace assembly described above comprises three separable parts for minimum dimensions when stowed, it may be possible to construct a collapsible wedge and brace assembly in which the wedges and brace are permanently hinged together. Numerous other modifications may be made to the gondola as disclosed without departing from the scope of the invention, as defined by the following claims.

I claim:

1. In a merchandising gondola kit, an improved base structure comprising base shelf support means having at least two spaced upper surfaces, a base shelf movably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced-upper surfaces of the base shelf support means, said wedge-shaped elements being stowable underneath the base shelf when the base shelf is directly supported on said upper surfaces of the base shelf support means, in which the means interposable between the base shelf support means and the base shelf further comprises brace means for connecting the wedge shaped elements to each other and supporting the wedge shaped elements against tilting, in which the base shelf support means comprises two substantially parallel, spaced elements, said upper surfaces being surfaces respectively of said spaced elements, in which the brace means is in the form of a channel of a size capable of receiving both of the wedge-shaped elements, in which the spaced elements of the base shelf support means respectively include means for supporting opposite ends of the brace means, and in which brace means, with the wedge-shaped elements received therein, are stowable between said spaced elements, with the opposite ends of the brace means supported by the respective base shelf support means, when the base shelf is directly supported on said upper surfaces of the base shelf support means.

2. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, in which each of the wedge-shaped elements comprises a unit formed of sheet metal, said unit having a web and two flanges extending perpendicular to the web from opposite edges thereof, and said web being tapered whereby the flanges diverge.

3. A merchandising gondola kit according to claim 2 in which one of the flanges has tab means extending therefrom in a direction parallel to the web and away from the other flange, and each of said upper surfaces of the base shelf support means has a slot for receiving the tab means of one of the flanges of one of the wedge-shaped elements.

4. A merchandising gondola kit according to claim 2 in which one of the flanges has tab means comprising two substantially coplanar, spaced, tabs extending therefrom in a direction parallel to the web and away from the other flange, the spacing between the tabs of each tab means being approximately $\frac{1}{8}$ inch, whereby the adjacent tabs of the tab means can be pried into a non-coplanar relationship by means of a screwdriver, and each of said upper surfaces of the base shelf support means having a slot for receiving the tab means of one of the flanges of one of the wedge-shaped elements.

5. A merchandising gondola kit according to claim 2 in which one of the flanges has tab means comprising two substantially coplanar, spaced, tabs extending therefrom in a direction parallel to the web and away from the other flange, the spacing between the tabs of each tab means being approximately $\frac{1}{8}$ inch, whereby the adjacent tabs of the tab means can be pried into a non-coplanar relationship by means of a screwdriver, each of said upper surfaces of the base shelf support means being in the form of a flange having a slot for receiving the tab means of on one of the flanges of one of the wedge-shaped elements, each of said flanges forming an upper surface of the base shelf support means extending horizontally in a direction away from the other of said upper surfaces whereby the tab means are accessible by a screwdriver located to the side of the base shelf support means.

6. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, in which the means interposable between the base shelf support means and the base shelf further comprises brace means for connecting the wedge shaped elements to each other and supporting the wedge shaped elements against tilting, in which the base shelf support means comprises two substantially parallel, spaced elements, said upper surfaces being surfaces respectively of said spaced elements, in which the spaced elements of the base shelf support means respectively include means for supporting opposite ends of the brace means, in which brace means is stowable between said spaced elements, with the opposite ends of the brace means supported by the respective base shelf support means, when the base shelf is directly supported on said upper surfaces of the base shelf support means, in which the base shelf has reinforcing rib means on its underside, and in which the brace means, when stowed between said spaced elements, with its opposite ends supported by the respective base shelf support means, is positioned to engage said reinforcing rib means and thereby provide additional support for the base shelf.

7. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, in which each of the wedge-shaped elements comprises a unit formed of sheet metal, said unit having a web and two flanges extending perpendicular to the web from opposite edges thereof, said web having a wide end and a narrow end whereby the flanges diverge, one of the flanges having tab means extending therefrom, at a location adjacent to the narrow end of the web, in a direction parallel to the web and away from the other flange, and in which the means interposable between the base shelf support means and the base shelf further comprises brace means, connectable to the webs of the wedge-shaped elements adjacent to the wide ends thereof, for connecting the wedge shaped elements to each other and supporting the wedge shaped elements against tilting, and in which each of said upper surfaces of the base shelf support means has a slot for receiving the tab means of one of the flanges of one of the wedge-shaped elements.

8. A merchandising gondola kit according to claim 7 in which each of said upper surfaces of the base shelf support means has a second slot for alternatively receiving the tab means of on one of the flanges of one of the wedge-shaped elements, whereby the interposable means can be reversed to support the base shelf in a forwardly inclined condition or in a rearwardly inclined condition.

9. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, said gondola kit having a rear upright section for supporting shelves, the upright section comprising a pair of spaced upright members and back panel means secured to the upright members and extending from one upright member to the other, in which the base shelf support means is secured to, and extends forwardly from, the lower end of the rear upright section, in which the interposable means is reversible, whereby the base shelf can be supported by the interposable means alternatively in a forwardly inclined condition or in a rearwardly inclined condition, and having additional panel means attachable to the base shelf adjacent to the forward edge thereof when the base shelf is in its forwardly inclined condition to provide a stop for preventing articles from sliding off the base shelf, and attachable to the upright members when the base shelf is in its rearwardly inclined condition to serve as a lower extension of said back panel means.

10. A merchandising gondola kit according to claim 9 in which the additional panel means is also attachable to the upright members when the base shelf is in its horizontal condition to serve as a lower extension of said back panel means.

11. A merchandising gondola kit according to claim 10 in which the lower edge of the additional panel means substantially meets the article-supporting surface of the base shelf when the base shelf is supported directly on said upper surfaces of the base shelf support means with its article-supporting surface substantially horizontal, the base structure including means for securing said interposable means on said base shelf support means, when positioned to support the base shelf in its rearwardly inclined condition, at a location such that the lower edge of the additional panel means also substantially meets the article-supporting surface of the base shelf when the base shelf is in its rearwardly inclined condition.

12. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, said gondola kit having a rear upright section for supporting shelves, the rear upright section comprising a pair of spaced upright members and back panel means secured to the upright members and extending from one upright member to the other, in which the base shelf support means is secured to, and extends forwardly from, the lower end of the rear upright section, and in which the interposable means supports the base shelf in a rearwardly inclined condition, the lower edge of the back panel means substantially meeting the article-supporting surface of the base shelf when the base shelf is supported directly on said upper surfaces of the base shelf support means with its article-supporting surface substantially horizontal, and the base structure including means for securing said interposable means on said base shelf support means, when positioned to support the base shelf in its rearwardly inclined condition, at a location such that the lower edge of the back panel means also substantially meets the article-supporting surface of the base shelf when the base shelf is in its rearwardly inclined condition.

13. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, in which the base shelf support means comprises two substantially parallel, spaced elements, said upper surfaces being surfaces respectively of said spaced elements, in which the means interposable between the base shelf support means and the base shelf further comprises horizontally elongated brace means for extending lengthwise between said wedge-shaped elements and connecting the wedge-shaped elements to each other and thereby supporting the wedge shaped elements against tilting, and in which said brace means includes depending means, engageable with at least one of said substantially parallel, spaced elements, for preventing horizontal movement of the brace means along the direction of its length.

14. A merchandising gondola kit according to claim 13 in which said depending means are simultaneously engageable with both of said substantially parallel, spaced elements, for preventing horizontal movement of the brace means along the direction of its length.

15. In a merchandising gondola kit, an improved base structure comprising base shelf support means having at least two spaced upper surfaces, a base shelf removably supportable directly on said upper surfaces, the base shelf having an article-supporting surface which is substantially horizontal when the base shelf is directly supported by said upper surfaces, and means interposable between the base shelf support means and the base shelf for alternatively supporting said base shelf on the base shelf support means with its article-supporting surface in an inclined condition, the interposable means comprising first and second wedge-shaped elements supportable respectively on said spaced upper surfaces of the base shelf support means, said wedge-shaped elements being stowable underneath the base shelf when the base shelf is directly supported on said upper surfaces of the base shelf support means, in which the means interposable between the base shelf support means and the base shelf further comprises brace means for connecting the wedge-shaped elements to each other and supporting the wedge-shaped elements against tilting, in which the base shelf has reinforcing rib means on its underside, and in which the brace means, when connecting the wedge-shaped elements in position to support the base shelf on the base shelf support means with its article-supporting surface in said inclined condition, is positioned to engage said reinforcing rib means and thereby provide additional support for the base shelf.

* * * * *